US010524334B1

(12) United States Patent
Price et al.

(10) Patent No.: US 10,524,334 B1
(45) Date of Patent: Dec. 31, 2019

(54) ELECTRICALLY ISOLATED SYSTEM AND METHOD FOR DIGITAL REGULATION OF A PROGRAMMABLE LIGHTING DEVICE

(71) Applicant: Universal Lighting Technologies, Inc., Madison, AL (US)

(72) Inventors: Scott Price, Madison, AL (US); John J. Dernovsek, Madison, AL (US); Stephen D. Mays, II, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 0 days.

(21) Appl. No.: 16/116,124

(22) Filed: Aug. 29, 2018

Related U.S. Application Data

(60) Provisional application No. 62/553,204, filed on Sep. 1, 2017.

(51) Int. Cl.
*H05B 37/02* (2006.01)
*H05B 33/08* (2006.01)

(52) U.S. Cl.
CPC ..... *H05B 37/0272* (2013.01); *H05B 33/0815* (2013.01); *H05B 33/0845* (2013.01)

(58) Field of Classification Search
CPC ..... H05B 37/0272; H05B 37/0227; H05B 37/0218; H05B 33/0845; H05B 33/0815
See application file for complete search history.

(56) References Cited

U.S. PATENT DOCUMENTS 6,144,539 A 11/2000 Konopka et al.
6,204,613 B1 3/2001 Hesterman
6,356,027 B1 3/2002 Zhang et al.
(Continued)

FOREIGN PATENT DOCUMENTS

EP 2306791 A2 6/2011
WO 2014013377 A2 1/2014

OTHER PUBLICATIONS

I2CBUS: NT3H1101/NT3H1201: I2C—Energy harvesting NFC Forum Type 2 Tag with field detection pin and I2C interface, Rev 3.3—Jul. 15, 2015, 265433, Product data sheet, Company Public.

*Primary Examiner* — Douglas W Owens
*Assistant Examiner* — Pedro C Fernandez
(74) *Attorney, Agent, or Firm* — Patterson Intellectual Property Law, P.C.; Gary L. Montle

(57) ABSTRACT

A lighting device (e.g. LED driver) includes digital dimming, configuration and firmware updating via wireless communication circuitry and associated volatile memory (e.g., SRAM). A power stage converts AC mains input into a DC bus voltage, and further converts the DC bus voltage into output current for driving a load. A power distribution circuit generates a regulated DC voltage based on the DC bus voltage. A wireless interface circuit is linked to a wireless communications network (e.g., NFC), and configured to receive device configuration data during at least first operating conditions when the regulated DC voltage is unavailable, and further to receive dimming control data during second operating conditions when the regulated DC voltage is available. A controller generates gate driving signals for regulating the output current from the power stage, said gate driving signals generated based at least in part on the device configuration data and the dimming control data.

20 Claims, 8 Drawing Sheets

(56) References Cited

U.S. PATENT DOCUMENTS

| | | | | |
|---|---|---|---|---|
| 7,333,353 | B2 | 2/2008 | Yin | |
| 7,750,577 | B2 | 7/2010 | Nerone et al. | |
| 8,654,485 | B1 | 2/2014 | Koehler | |
| 9,565,744 | B2 | 2/2017 | Lai et al. | |
| 9,681,512 | B1 | 6/2017 | Xiong et al. | |
| 2008/0041930 | A1* | 2/2008 | Smith | G06F 9/44505 235/375 |
| 2010/0102747 | A1 | 4/2010 | Ilyes et al. | |
| 2010/0181935 | A1 | 7/2010 | Wu | |
| 2011/0080107 | A1* | 4/2011 | Khalsa | H05B 41/046 315/250 |
| 2012/0262432 | A1 | 10/2012 | Kamata et al. | |
| 2015/0054423 | A1 | 2/2015 | Tyson et al. | |
| 2016/0165702 | A1* | 6/2016 | Lai | H05B 37/0272 315/201 |
| 2017/0238397 | A1* | 8/2017 | Green | H04B 5/0062 315/129 |

* cited by examiner

ELECTRICALLY ISOLATED SYSTEM AND METHOD FOR DIGITAL REGULATION OF A PROGRAMMABLE LIGHTING DEVICE

CROSS-REFERENCES TO RELATED APPLICATIONS

This application claims benefit of U.S. Provisional Patent Application No. 62/553,204, filed Sep. 1, 2017, and which is hereby incorporated by reference.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND

The present invention relates generally to lighting devices such as light emitting diode (LED) drivers. More particularly, an embodiment of an invention as disclosed herein relates to an electrically isolated method for digitally dimming, configuring and updating the firmware of a programmable lighting device through wireless communication and volatile memory.

For many luminaire manufacturers it may be desirable to configure the operating parameters of LED drivers before shipping to customers for installation, without requiring coupling of the LED drivers to a mains power source. It is further desirable to configure various operating parameters of the LED driver at other stages of application, again without having to apply mains input power to the LED driver. For example, when a driver is first removed from its packaging, it may be desired to apply a default configuration to satisfy the needs for most of the LED drivers at a particular installation. Further, once a new driver is installed with other LED drivers in a luminaire, it may be required that all the drivers in the luminaire or series of luminaires receive a configuration unique to their installation.

One way for end users or LED light fixture manufacturers to be able to configure operating parameters of LED drivers in a safe, quick, and easy way is to load configuration parameters into the non-volatile storage memory medium, such as flash memory, of an integrated circuit (IC) for a Near-field communication (NFC) tag in the LED driver while the LED driver itself is unpowered, through the use of a configuration device equipped with a Radio-frequency identification (RFID) transceiver IC and antenna.

However, non-volatile memory storage is not suitable for the continuous data transfer needed for continuous digital dimming interfaces. For example, if a digital dimming controller with an NFC transceiver IC and antenna were permanently mechanically connected to the NFC antenna on the LED driver, and sent dimming commands to the LED driver every 200 milliseconds, the non-volatile memory (e.g., EEPROM) in the IC (e.g., NT3H1101 offered by NXP Semiconductors) would reach its 500 k write endurance limit in 83 days of run time.

It is accordingly desired to provide a lighting device such as an LED driver with a wireless communication interface having adequate functionality to support or otherwise provide a continuous digital dimming interface to external dimming control devices.

It may also be desirable that a luminaire or series of luminaires be able to report data regarding its particular operation, such as input or output power.

It may further be desirable to provide a relatively low cost interface circuit with inherent protection against the potential misapplication of line voltages.

BRIEF SUMMARY

An invention as disclosed herein provides a mechanism for both of configuration and digital dimming through a single wireless (e.g., NFC) interface. This interface will typically be inherently electrically isolated, relying for example on an NFC field coupling between an antenna on the external controller side and an antenna on the lighting device (e.g., LED driver) side. Furthermore, various embodiments of an invention as disclosed herein do not require additional circuitry for a wired digital dimming interface, and there is no need for protection of the communication lines against misapplication of line (mains) inputs because there are no physical communication wires.

Put differently, an invention as disclosed herein provides desired configurability and digital dimming features without the wired communication circuitry (and associated cost). If the majority of customers desire to configure the lighting device without having to apply a mains input, this can be accomplished via integration of the wireless interface as disclosed herein. The ability to also send digital dimming commands through the wireless interface adds further desirable features without adding cost, thereby targeting more end user applications with a single product.

As previously noted, the use of non-volatile memory is problematic for the continuous data transfer needed for continuous digital dimming interfaces. Such a limitation may be overcome by using volatile memory for data transfer between the wireless interface and the device controller, as detailed in this disclosure. Such an arrangement is demonstrably faster than the convention reliance on non-volatile memory for the interface. Using for example the aforementioned NXP NT3H1101 Type 2 tag with both EEPROM and static random-access memory (SRAM), it takes 4.5 mS to write 16 bytes of data to its EEPROM, and only 0.4 mS to write 16 bytes of data to its SRAM.

Accordingly, a lighting device as described herein may implement volatile memory (e.g., SRAM) that is already built into many Tag ICs and a wireless interface to provide the following exemplary aspects.

In one aspect, an inherently electrically isolated digital communication interface is provided with respect to a controller for a lighting device (e.g., LED driver) through the use of a wireless (e.g., RFID) interface.

In another aspect, the lighting device as disclosed herein allows for a high throughput of data transfer between the controller controlling an LED power supply and an external device not susceptible to memory wear-out due to reliance on volatile memory.

In another aspect, the lighting device as disclosed herein allows for a device external to the LED driver to negotiate (through means of a communication protocol) new configurable parameters with the controller controlling the LED power supply.

The aforementioned aspect may further allow for a device external to the LED driver to quickly push firmware updates to the controller controlling the LED driver power supply.

Each of the aforementioned aspects may be available to an LED driver as disclosed herein, while the LED driver power supply itself is not powered by mains input if the controller controlling the LED driver power supply is being powered by the energy harvested by the NFC field, or by power otherwise supplied by a device external to the LED driver.

If an LED driver as disclosed herein is powered by mains, each of the aforementioned aspects may be available to the LED driver, while further allowing for a device external to the LED driver to send digital dimming commands and request diagnostic and power reporting data in real time from the controller controlling the LED driver power supply.

In a particular embodiment of a lighting device as disclosed herein, a wireless interface circuit is coupled to an antenna and linked thereby to a wireless communications network, wherein the wireless interface circuit is configured to receive device configuration data via the wireless communications network during at least a first operating condition when the AC mains input power is not applied to the lighting device, and further to receive dimming control data via the wireless communications network during a second operating condition when the AC mains input power is applied to the lighting device. A controller is also provided and configured to generate output current reference signals for regulating the output current from a driving circuit associated with the lighting device, said reference signals corresponding to the device configuration data and the dimming control data.

In an embodiment, the lighting device further includes a level shifting circuit coupled between the controller and the wireless interface circuit, and configured to step a first supply voltage output from the controller to a second supply voltage as an input to the wireless interface circuit.

In an embodiment, the wireless interface circuit comprises a volatile memory unit for storing the data received via the wireless communications network.

In an embodiment, the wireless interface circuit is configured to transfer and receive device configuration data in a bidirectional negotiation with the external device via the wireless communications network.

In an embodiment, the wireless interface circuit may in addition or alternatively be configured to receive push updates of configurable parameters associated with the device configuration data from the external device via the wireless communications network.

In an embodiment, the controller is configured to transmit real time diagnostic and/or power reporting data to the external device via the wireless interface circuit and the wireless communications network, during the second operating condition.

In an embodiment, the wireless interface circuit is also configured to receive device configuration data via the wireless communications network during the second operating condition.

In an embodiment, the controller is configured to receive input power harvested by the wireless interface circuit during the first operating condition.

In an embodiment, the lighting device further comprises one or more power input terminals coupled to the controller, wherein the controller is configured to receive input power from an external power supply coupled thereto during the first operating condition.

In an embodiment, the lighting device further comprises an auxiliary power supply coupled to the AC mains input and configured to provide output power to an external device during the second operating condition.

In an embodiment, the lighting device further comprises an analog interface circuit and one or more input terminals coupled to the analog interface circuit and configured for coupling to an external analog dimming device.

In an embodiment, the controller is configured to sample input signals from the wireless interface circuit during the second operating condition to detect the presence or absence of an external device coupled to the wireless communications network, and to enable the analog interface circuit only in the detected absence of the external device coupled to the wireless communications network.

DETAILED DESCRIPTION

Figure 1:
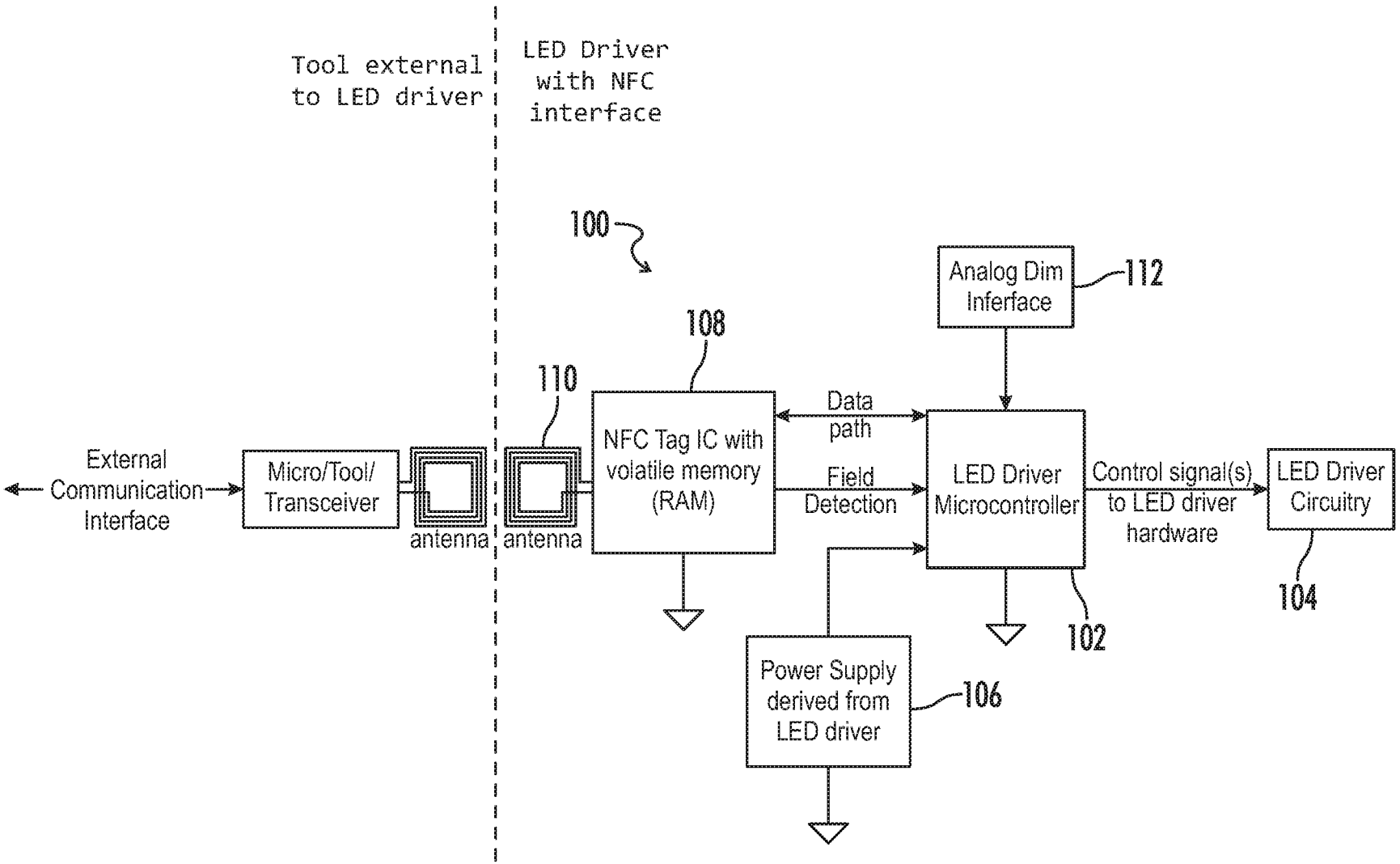
FIG. 1 is a block diagram representing an embodiment of a lighting device as disclosed herein.

Referring generally to FIGS. 1-9, various exemplary embodiments of an invention may now be described in detail. Where the various figures may describe embodiments sharing various common elements and features with other embodiments, similar elements and features are given the same reference numerals and redundant description thereof may be omitted below.

Referring first to FIG. 1, an embodiment of a lighting device 100 as disclosed herein includes a controller 102 that is configured to generate control signals to regulate one or more operations of a power stage 104 for the device. In one example the power stage includes input terminals to receive input power from an external power supply, such as for example an AC mains input, and is configured to convert the AC input power to provide an appropriate output power for driving a light source, or load. In particular embodiments as described below, the lighting device 100 is an LED driver for generating output current to a light source comprising one or more LED's. The power stage 104 may typically include an AC-DC section (not shown), configured for example as a diode bridge rectifier to convert the AC mains input into an intermediate DC bus voltage V1.

The power stage 104 may further include a DC-DC section (not shown) with switching circuitry, alone or as provided with additional rectifying circuitry, for further converting of the DC bus voltage into a DC output to the load. In an embodiment for example the DC-DC section may include a DC-AC stage wherein the switching circuitry produces an AC current through a primary winding of an isolation transformer, and an AC-DC stage including a secondary winding of the transformer and a diode bridge to rectify an AC current there through into an output DC current to the load. A current sensor such as a current sensing resistor may be coupled in series with the load, wherein a voltage develops on a current sensing terminal that has a magnitude with respect to a secondary circuit ground reference that is proportional to the current flowing through the load, and may be provided as control feedback (see below). A power stage controller (not shown) may be provided to regulate a switching frequency of the DC-DC section based on a desired output current.

A device controller 102 may be configured to provide gate driving signals directly to one or more switching elements in the LED driver power stage, or may alternatively be configured to for example provide dimming control signals to a gate driver circuit that provides the aforementioned driving signals to the one or more switching elements, based in part on power stage feedback signals such as for example actual output current. Still further in the alternative, the illustrated controller 102 may be separately provided with respect to another power stage controller or control circuitry (not shown) which itself receives dimming reference signals from the controller 102 and generates gate driver control signals to the switching elements based on power stage feedback. In such embodiments, the power stage circuitry 104 may for example include a proportional integral (PI) control loop with an operational amplifier or equivalent for comparing a dimming output signal from the controller 102 with feedback signals for the purpose of generating an error signal, further fed back directly or via an isolation element to a gate drive integrated circuit for regulating switching operation (e.g., duty cycle control) of the switching elements in the power stage.

The terms "controller," "control circuit" and "control circuitry" as used herein may refer to, be embodied by or otherwise included within a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed and programmed to perform or cause the performance of the functions described herein. A general purpose processor can be a microprocessor, but in the alternative, the processor can be a microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration.

A wireless interface circuit 108 is functionally linked to the controller 102 to provide a data path and field detection. For convenience of illustration, the wireless interface circuit 108 may be referred to herein as using an NXP NT3HXXXX Type 2 Tag IC as is known in the art with EEPROM, an SRAM buffer for fast data transfer, a field detect pin, an energy harvesting output, and an I2C interface. However, the aforementioned example is not limiting on the scope of the invention and any other type of wireless (e.g., RF) tag with some form of volatile memory (e.g., FIFO, etc.) for data transfer and an interface to communicate with the controller 102 may be applicable.

The wireless interface circuit 108 is configured for wireless communication with a device such as a configuration tool external to the lighting device. Particular description or definition of the external NFC device is beyond the scope of this disclosure, but it may include an NFC antenna permanently mechanically coupled to the LED driver's NFC antenna, or temporarily but securely coupled to the LED driver's NFC antenna for unpowered LED driver parameter configuration or firmware update.

The term lighting device configuration data may be used herein to refer to parameters that are received and stored for programming operation of the lighting device (e.g., LED driver). Exemplary configuration data may include parameters (or values associated with said parameters) such as minimum and maximum output currents, dimming curve (e.g., linear, logarithmic), dimming control voltages, on/off states for enabling or disabling various programmable features such as lumen maintenance, a threshold voltage for triggering on/off functions, etc.

The term dimming control data may typically as used herein refer to digital inputs corresponding to a lighting output such as a 0-100% dimming value, or an equivalent as allowable for the particular lighting device or load. Otherwise stated, the dimming control data may specify a desired lighting output, whereas the device configuration data may specify internal operating parameters enabling the device controller to appropriately provide the desired lighting output.

In the embodiment of FIG. 1, the controller 102 may be provided with power derived from the LED driver power stage, such as for example via a voltage regulator coupled to the DC bus voltage when an AC mains input is available, but does not derive power from the wireless interface circuit.

Figure 2:
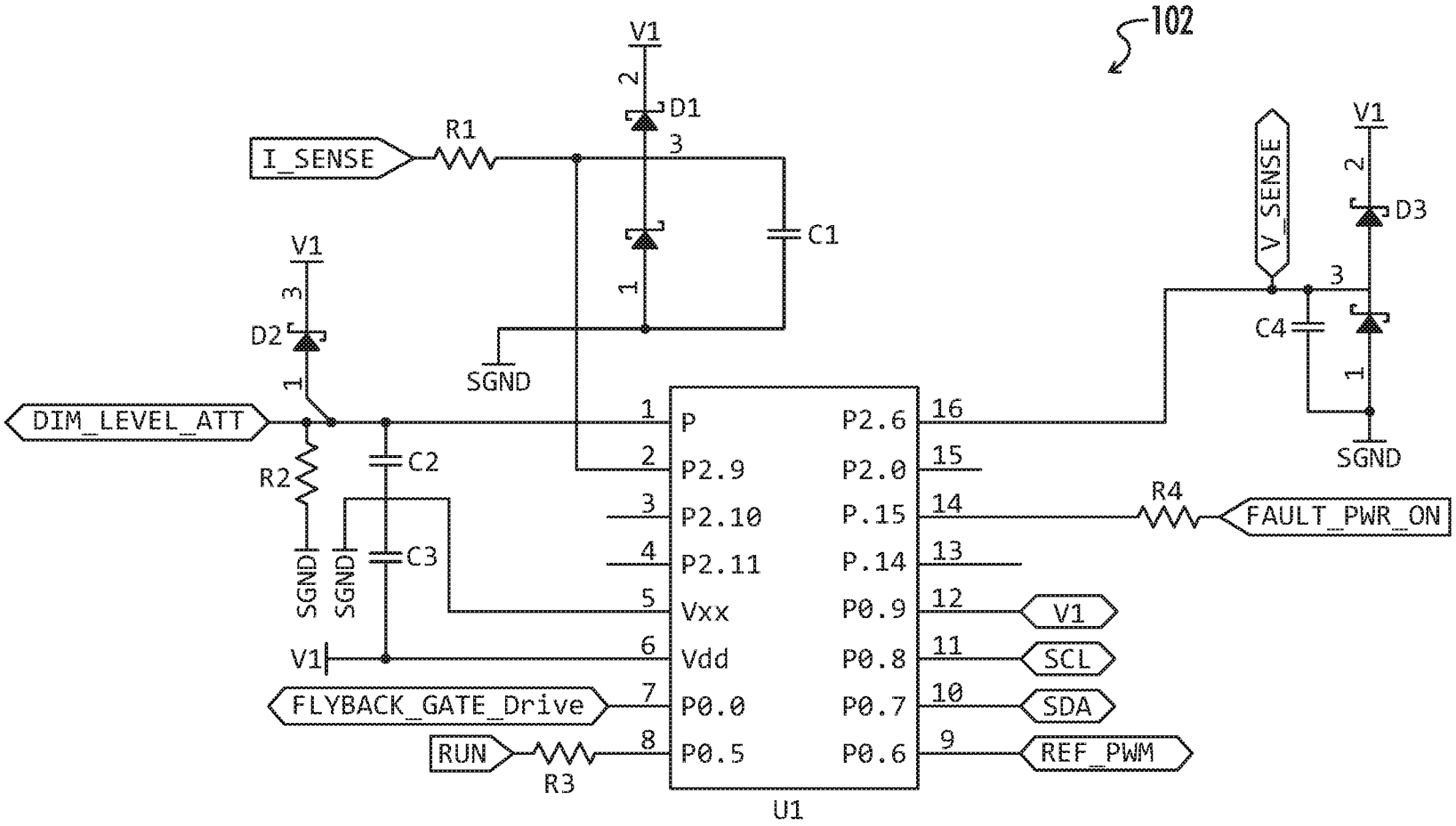
FIG. 2 is a circuit diagram representing an exemplary controller for the embodiment of FIG. 1.
Figure 3:
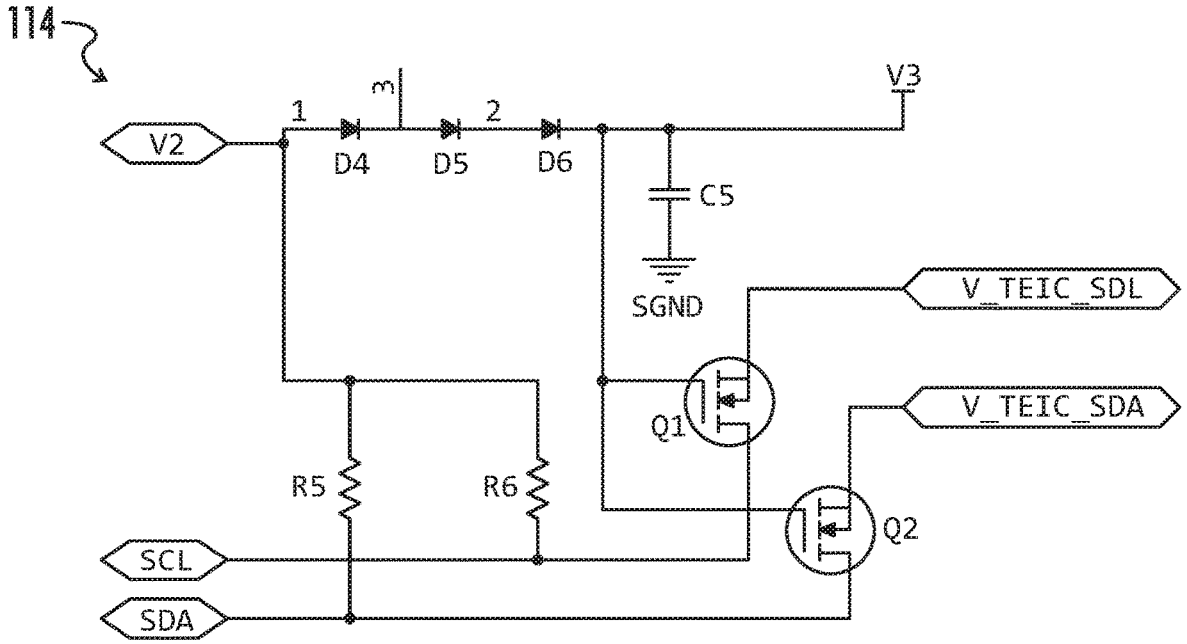
FIG. 3 is a circuit diagram representing an exemplary level shifting circuit for the embodiment of FIG. 1.
Figure 4:
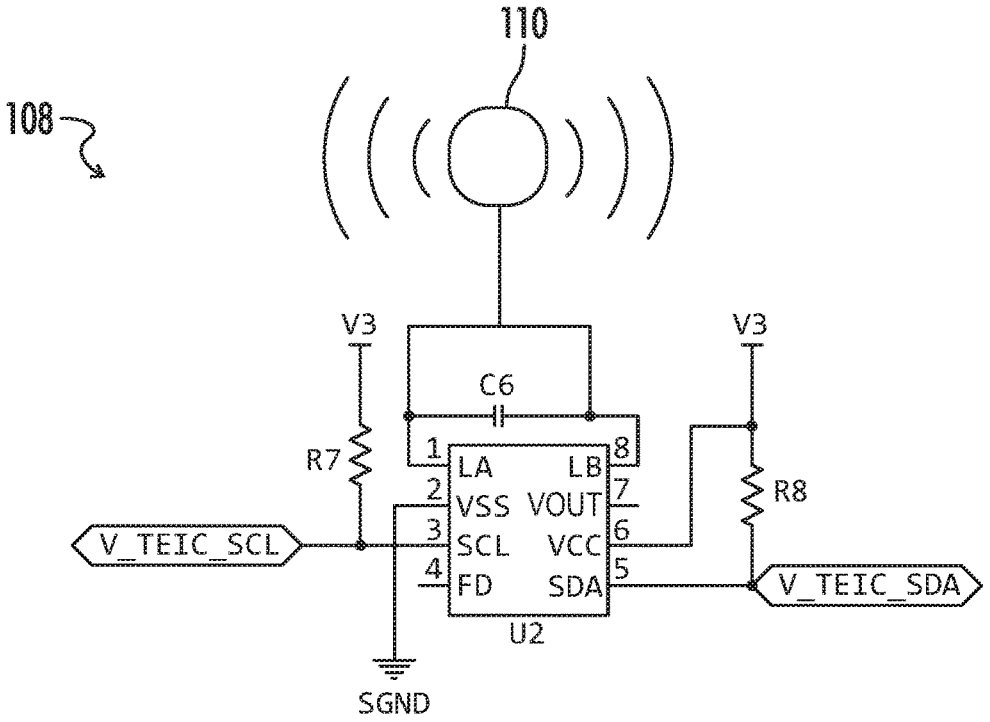
FIG. 4 is a circuit diagram representing an exemplary wireless interface circuit for the embodiment of FIG. 1.
Figure 5:
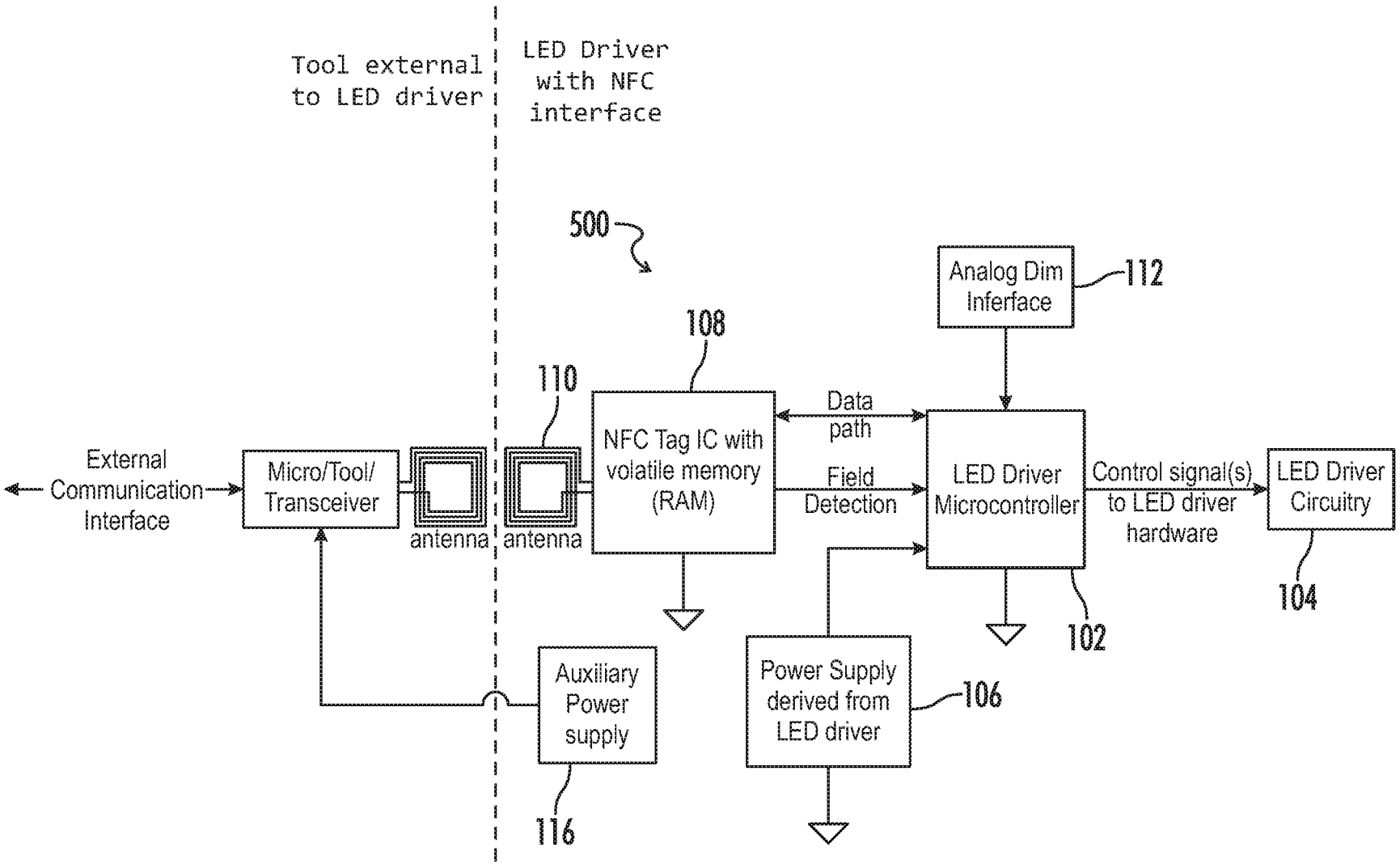
FIG. 5 is a block diagram representing another embodiment of a lighting device as disclosed herein.

Referring next to FIG. 2, the controller 102 includes an IC (U1) and associated circuitry, for example coupling the IC to receive feedback signals such as for example an output current sensing input (I_sense) from a current sensor coupled in series with the load, a voltage sensing input (V_sense), etc. The controller senses or determines a dimming control voltage and provides a pulse width modulated (PWM) reference output signal (REF_PWM), for example according to a dimming curve set by an internal algorithm. The controller is interfaced to an I2C interface (SDA, SCL pins) of NFC tag IC (U2 in FIG. 4) via pins P0.7 and P0.8 of IC U1. The controller 102 also provides power to the wireless interface circuit 108 through general purpose IO pin P0.9.

In this example, the controller 102 runs off of a first voltage V1 (e.g., 5V) as derived from the LED driver power stage, and the wireless interface circuit 108 runs off of a second voltage V3 (e.g., 3.6V maximum). Accordingly, an output voltage V2 from the controller is reduced through three series diodes D4, D5, D6 in level shifting circuit 114 (see FIG. 3) to a safe supply voltage V3 for the wireless interface circuit tag IC (U2), and the I2C interface is level-shifted to provide safe and recognizable digital levels on both sides of the interface. The serial data pin SDA from the controller IC is provided to the level shifting circuit 114 and coupled to the drain of switching element Q2, while the source of switching element Q2 is coupled to the serial data pin (pin 5 of U2) in the wireless interface circuit. A resistor R5 is coupled between the controller's output voltage V2 and the serial data input SDA, and the level-shifted supply voltage V3 is coupled to the gate of the switching element Q2. The serial clock pin SCL from the controller IC is also provided to the level shifting circuit 114 and coupled to the drain of a switching element Q1, while the source of switching element Q1 is coupled to the serial clock pin (pin 3 of U2) in the wireless interface circuit 108. Another resistor R6 is coupled between the controller's output voltage V2 and the serial clock input SCL, and the level-shifted supply voltage V3 is coupled to the gate of the switching element Q1.

The tag IC itself is connected to an NFC antenna 110, which in an embodiment may simply be formed by a plurality of turns on a multi-layer printed circuit board (PCB) that is outside of—or simply not fully encased within—the LED driver's metal can.

The aforementioned configuration and associated circuit components may allow a configuration tool (e.g., NFC device) external to the LED driver to establish communication with the LED driver's controller when the LED driver is powered by an AC mains input, via the inherently isolated NFC interface. Because the NFC interface itself is electrically isolated, there is no further need for isolation internal to the LED driver for the communication interface.

The external NFC-enabled device and the LED driver controller use the Tag IC's volatile SRAM as the communication medium, making this configuration suitable for use as a constant digital communication interface between the LED driver and devices external to the LED driver that is not subject to the wear-out mechanisms associated with conventional applications that implement volatile memory.

It may be understood that an external NFC-enabled device could itself be powered directly by the same AC mains as the lighting device. Alternatively, with reference next to FIG. 5, an embodiment of a lighting device 500 as disclosed herein may further include an auxiliary power supply to power the external device that communicates with the wireless interface circuit 108 via antenna 100.

Figure 6:
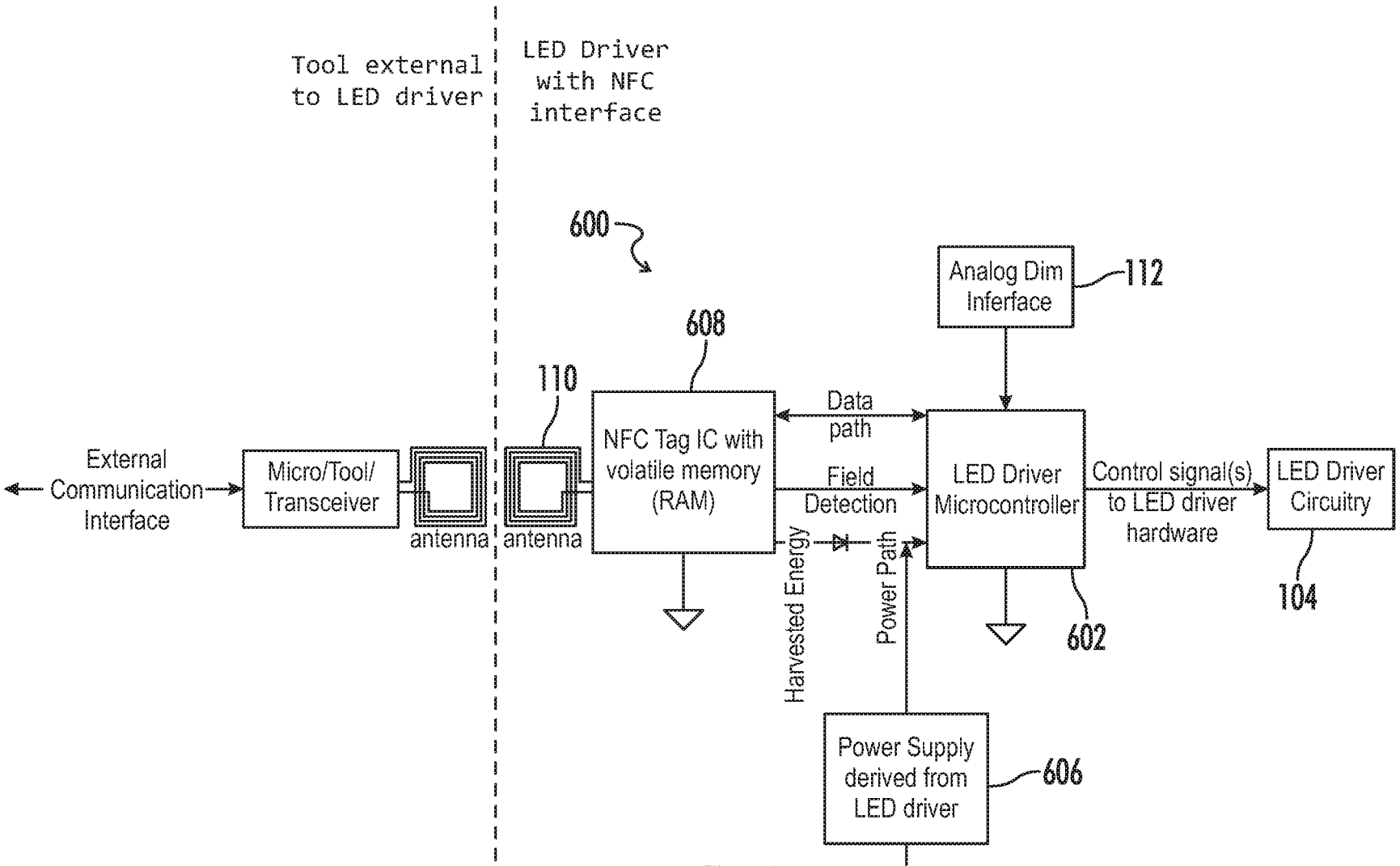
FIG. 6 is a block diagram representing another embodiment of a lighting device as disclosed herein.

Referring next to FIG. 6, in an alternative embodiment of the lighting device 600 a wireless interface circuit 608 may be configured to provide power to the controller 602 when the power stage 104 is not powered by AC mains and therefore unable to provide a regulated DC input 606 to the controller.

Figure 8:
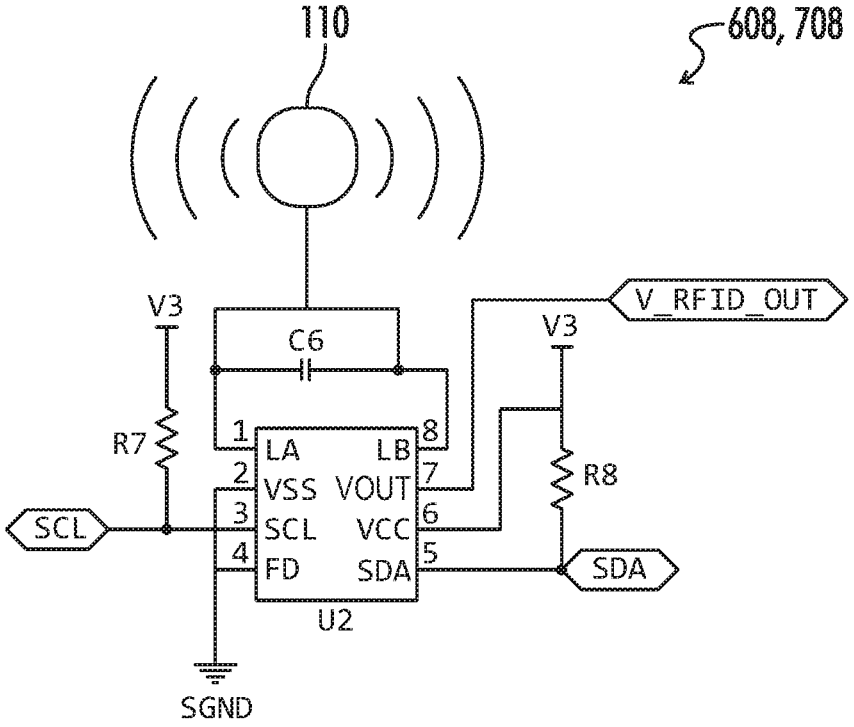
FIG. 8 is a circuit diagram representing an exemplary wireless interface circuit for at least the embodiment of FIG. 6.
Figure 9:
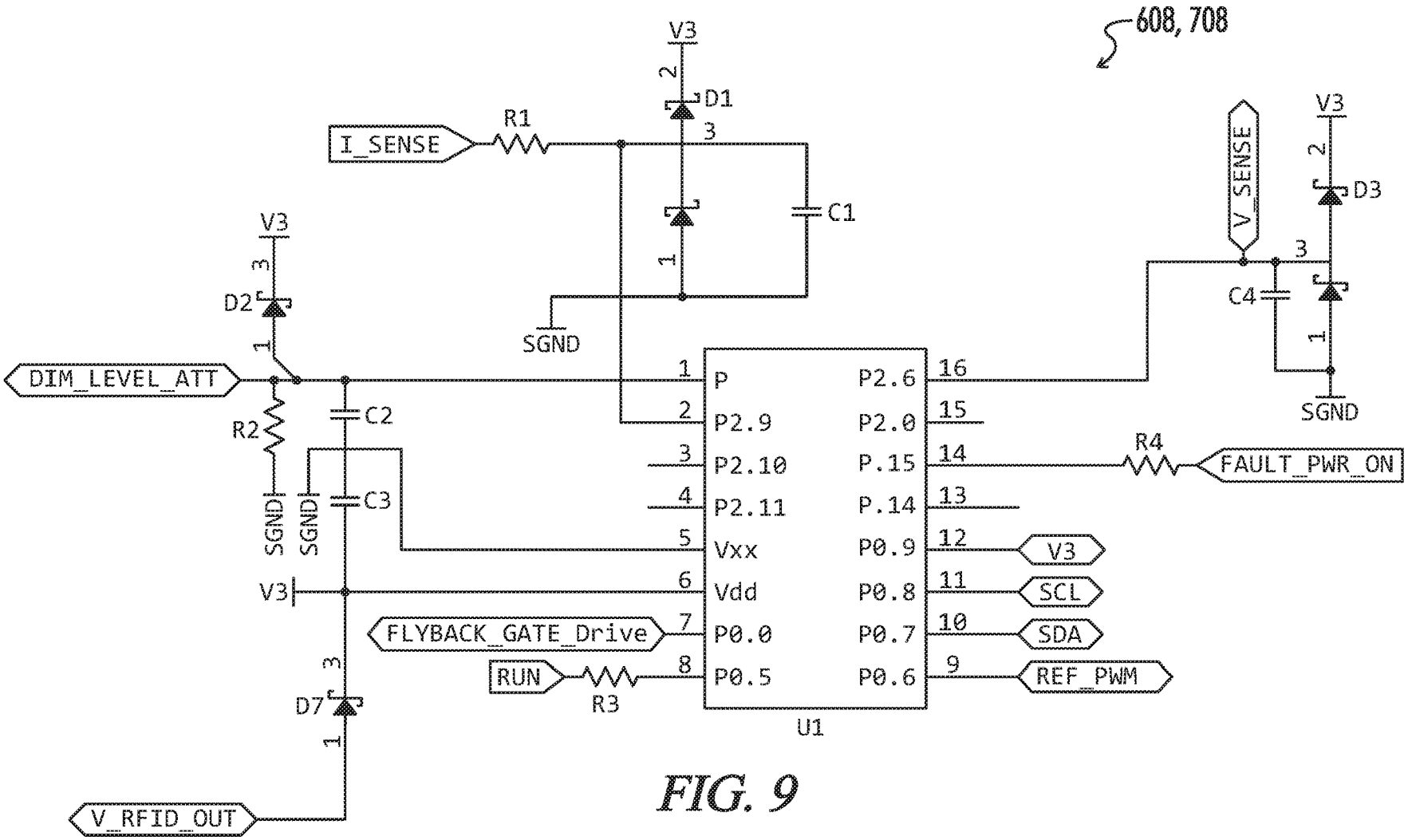
FIG. 9 is a circuit diagram representing an exemplary controller for at least the embodiment of FIG. 6.

As represented in greater detail in FIGS. 8 and 9, the LED driver controller 602 may be configured to run off of the same voltage level V3 (e.g., 3.3V) as the wireless interface circuit 608, and also to receive power from the energy harvested by the tag IC from the NFC field when the LED driver itself is not energized by AC mains input, but the Tag IC is energized by an external NFC device. The level shifter is no longer necessary and is therefore eliminated from this embodiment as both the controller and Tag IC are running off the same voltage level.

Figure 7:
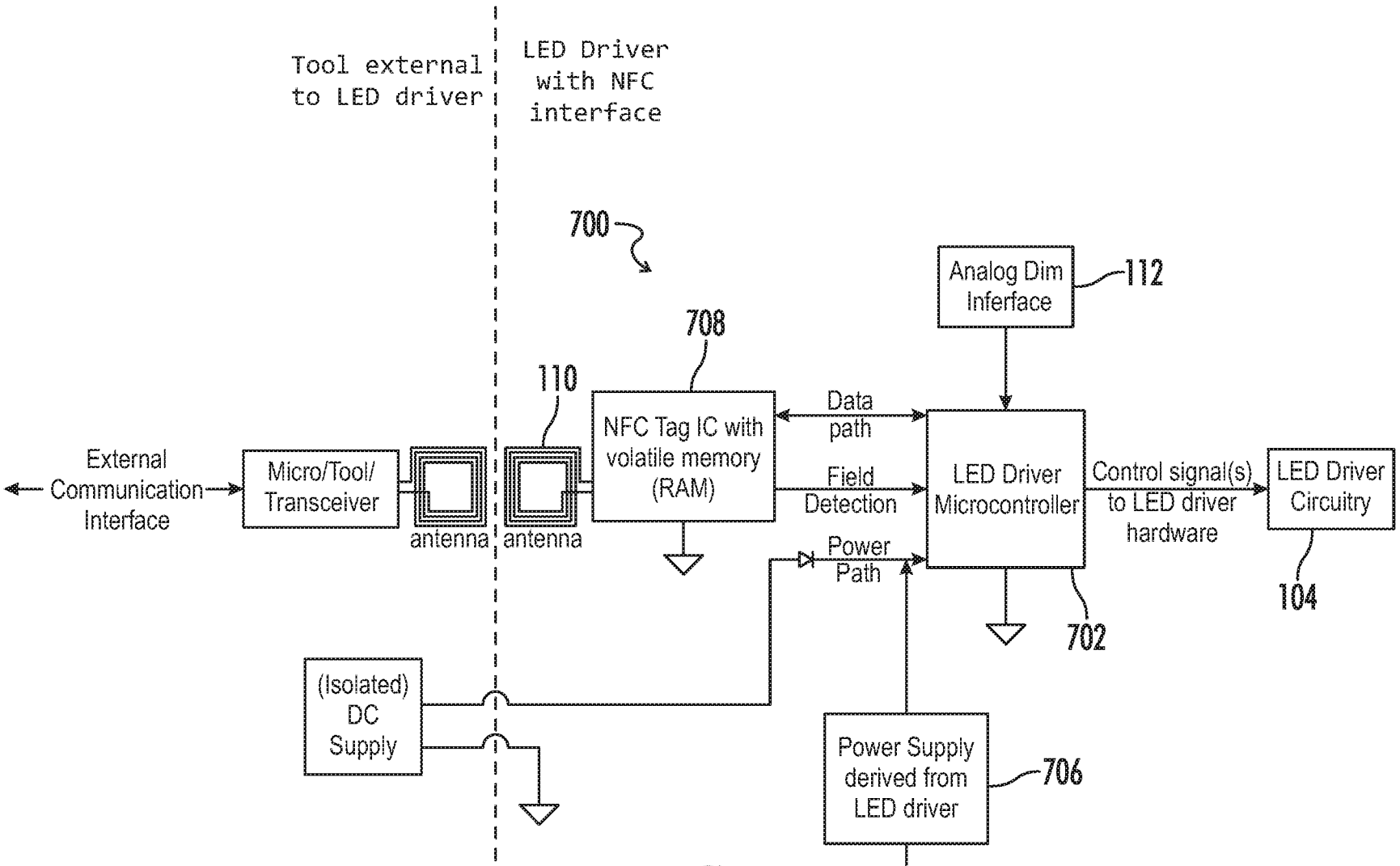
FIG. 7 is a block diagram representing another embodiment of a lighting device as disclosed herein.

Another alternative embodiment of a lighting device 700 is depicted in FIG. 7, wherein the external NFC-enabled device has a power supply to power the LED driver's controller. Each of the embodiments in FIGS. 6 and 7 can allow communication between an NFC device external to the LED driver and the LED driver's controller when the LED driver is not powered by AC mains. However, if the LED driver controller cannot sustainably run off the energy harvested from the NFC field by the Tag IC, the external NFC device can internally house the circuitry needed to power the LED driver controller, only needing a physical connection to the LED driver itself (external wires, an electrical connector, or exposed electrical pads for 'pogo'-type pin connections) to power its controller 702.

Various embodiments of a lighting device as disclosed herein allow for unpowered LED driver parameter configuration where the LED driver's controller and an external NFC device can communicate back and forth through the Tag IC's volatile memory to negotiate parameters, or at least provide a negative acknowledgement if a requested configurable parameter is outside the operating limits of the LED driver. Certain configurations also allow for unpowered update of the LED driver's firmware. The same circuitry can then still be used as a communication path for digital dimming, power reporting, etc. while the LED driver is powered by AC mains input.

To support the most possible applications, the LED driver could still have an analog dimming interface. For the LED driver to support both the analog dimming interface and digital dimming through the wireless interface, the LED driver's controller may be configured to sample the Tag IC's field detect output or energy harvesting pin to determine if an external NFC device is coupled to the LED driver. The LED driver controller can use the presence or absence of this signal to determine if it should use the analog dimming interface or the digital (wireless) dimming interface.

Throughout the specification and claims, the following terms take at least the meanings explicitly associated herein, unless the context dictates otherwise. The meanings identified below do not necessarily limit the terms, but merely provide illustrative examples for the terms.

The meaning of "a," "an," and "the" may include plural references, and the meaning of "in" may include "in" and "on." The phrase "in one embodiment," as used herein does not necessarily refer to the same embodiment, although it may.

The term "coupled" means at least either a direct electrical connection between the connected items or an indirect connection through one or more passive or active intermediary devices.

The term "circuit" means at least either a single component or a multiplicity of components, either active and/or passive, that are coupled together to provide a desired function.

The term "wireless communications network" as used herein may refer to any interconnection for short-range data communication or transfer between two or more devices linked thereto, including intermediate communication interfaces and associated transmission media, and including or employing any of a variety of network topologies and communication protocols. In a particular and non-limiting example as described herein, a short-range wireless communications network may include an NFC subsystem for contact or non-contact communication between at least a first NFC device or tag and at least a second NFC device or tag, each of said NFC devices or tags associated with respective antennae (or equivalent inductive coil) configured for example to receive NFC signals within a set frequency band.

The terms "switching element" and "switch" may be used interchangeably and may refer herein to at least: a variety of transistors as known in the art (including but not limited to FET, IGBT, IGFET, etc.), a switching diode, a silicon controlled rectifier (SCR), a diode for alternating current (DIAC), a triode for alternating current (TRIAC), a mechanical single pole/double pole switch (SPDT), or electrical, solid state or reed relays. Where either a field effect transistor (FET) or a bipolar junction transistor (BJT) may be employed as an embodiment of a transistor, the scope of the terms "gate," "drain," and "source" includes "base," "collector," and "emitter," respectively, and vice-versa.

The terms "power converter" and "converter" unless otherwise defined with respect to a particular element may be used interchangeably herein and with reference to at least DC-DC, DC-AC, AC-DC, buck, buck-boost, boost, half-bridge, full-bridge, H-bridge or various other forms of power conversion or inversion as known to one of skill in the art.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. A lighting device comprising:

a driving circuit configured to convert AC mains input power into an output current for driving a lighting load;

a wireless interface circuit coupled to an antenna and comprising a volatile memory interface, wherein the wireless interface circuit is configured to receive device configuration data from at least a first external device via the volatile memory interface during at least a first operating condition when the AC mains input power is not applied to the lighting device, and further to continuously receive dimming control data from the at least first external device during a second operating condition when the AC mains input power is applied to the lighting device; and a controller configured to generate output current reference signals for regulating the output current from the driving circuit during the second operating condition, said reference signals corresponding to the device configuration data and the dimming control data.

2. The lighting device of claim 1, wherein the wireless interface circuit comprises a dual-port static random access memory (SRAM) device configured for fast data transfer via a synchronous or asynchronous serial interface.

3. The lighting device of claim 1, further comprising a level shifting circuit coupled between the controller and the wireless interface circuit, and configured to step a first supply voltage output from the controller to a second supply voltage as an input to the wireless interface circuit.

4. The lighting device of claim 1, wherein the wireless interface circuit is configured for bidirectional negotiation with the external device regarding device configuration data to be received from the external device and transferred to the controller.

5. The lighting device of claim 1, wherein the wireless interface circuit is configured to receive push updates of configurable parameters associated with the device configuration data from the external device.

6. The lighting device of claim 1, wherein the controller is configured to transmit real time diagnostic and/or power reporting data to the external device via the volatile memory interface, during the second operating condition.

7. The lighting device of claim 1, wherein the wireless interface circuit is also configured to receive device configuration data and/or firmware updates during the second operating condition.

8. The lighting device of claim 1, wherein the controller is configured to receive input power harvested by the wireless interface circuit during the first operating condition.

9. The lighting device of claim 1, further comprising one or more power input terminals coupled to the controller, wherein the controller is configured to receive input power from an external power supply coupled thereto during the first operating condition.

10. The lighting device of claim 1, further comprising an auxiliary power supply coupled to the AC mains input and configured to provide output power to an external device during the second operating condition.

11. The lighting device of claim 1, further comprising an analog interface circuit and one or more input terminals coupled to the analog interface circuit and configured for coupling to an external analog dimming device, wherein the controller is configured to sample input signals from the wireless interface circuit during the second operating condition to detect the presence or absence of an external device, and to enable the analog interface circuit only in the detected absence of the external device.

12. A lighting device comprising:

a driving circuit configured to convert AC mains input power into an output current for driving a lighting load;

a wireless interface circuit coupled to an antenna and comprising a volatile memory interface, wherein the wireless interface circuit is configured to receive device configuration data from at least a first external device via the volatile memory interface during at least a first operating condition when the AC mains input power is not applied to the lighting device, and further to receive dimming control data from the at least first external device during a second operating condition when the AC mains input power is applied to the lighting device;

a controller configured to generate output current reference signals for regulating the output current from the driving circuit, said reference signals corresponding to the device configuration data and the dimming control data; and a level shifting circuit coupled between the controller and the wireless interface circuit, and configured to step a first supply voltage output from the controller to a second supply voltage as an input to the wireless interface circuit.

13. The lighting device of claim 12, wherein the wireless interface circuit is configured for bidirectional negotiation with the external device regarding device configuration data to be received from the external device and transferred to the controller.

14. The lighting device of claim 12, further comprising one or more power input terminals coupled to the controller, wherein the controller is configured to receive input power from an external power supply coupled thereto during the first operating condition.

15. The lighting device of claim 12, further comprising an auxiliary power supply coupled to the AC mains input and configured to provide output power to an external device during the second operating condition.

16. The lighting device of claim 12, further comprising an analog interface circuit and one or more input terminals coupled to the analog interface circuit and configured for coupling to an external analog dimming device, wherein the controller is configured to sample input signals from the wireless interface circuit during the second operating condition to detect the presence or absence of an external device, and to enable the analog interface circuit only in the detected absence of the external device.

17. A lighting device comprising:

a driving circuit configured to convert AC mains input power into an output current for driving a lighting load;

a wireless interface circuit coupled to an antenna and comprising a volatile memory interface, wherein the wireless interface circuit is configured to receive device configuration data from at least a first external device via the volatile memory interface during at least a first operating condition when the AC mains input power is not applied to the lighting device, and further to receive dimming control data from the at least first external device during a second operating condition when the AC mains input power is applied to the lighting device; and a controller configured to generate output current reference signals for regulating the output current from the driving circuit, said reference signals corresponding to the device configuration data and the dimming control data, wherein the wireless interface circuit is configured for bidirectional negotiation with the external device regarding device configuration data to be received from the external device and transferred to the controller during the first operating condition.

18. The lighting device of claim 17, further comprising one or more power input terminals coupled to the controller, wherein the controller is configured to receive input power from an external power supply coupled thereto during the first operating condition.

19. The lighting device of claim 17, further comprising an auxiliary power supply coupled to the AC mains input and configured to provide output power to an external device during the second operating condition.

20. The lighting device of claim 17, further comprising an analog interface circuit and one or more input terminals coupled to the analog interface circuit and configured for coupling to an external analog dimming device, wherein the controller is configured to sample input signals from the wireless interface circuit during the second operating condition to detect the presence or absence of an external device, and to enable the analog interface circuit only in the detected absence of the external device.

* * * * *